US008991339B2

(12) United States Patent
Gooden et al.

(10) Patent No.: US 8,991,339 B2
(45) Date of Patent: Mar. 31, 2015

(54) MULTI-ZONE VEHICLE RADIATORS

(75) Inventors: James Thomas Gooden, Canton, MI (US); Scott Russo, Novi, MI (US); Michael Joseph Giunta, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 160 days.

(21) Appl. No.: 13/435,957

(22) Filed: Mar. 30, 2012

(65) Prior Publication Data

US 2013/0255601 A1 Oct. 3, 2013

(51) Int. Cl.

| | |
|---|---|
| ***F01P 7/14*** | (2006.01) |
| ***F28D 1/04*** | (2006.01) |
| ***F28F 27/02*** | (2006.01) |

(52) U.S. Cl.

CPC ..... *F28D 1/0417* (2013.01); *F28F 27/02* (2013.01)

USPC ..... 123/41.08; 123/41.09; 123/41.01; 123/41.02; 123/41.29; 123/41.33; 123/41.1; 123/41.49; 165/41; 165/51; 165/287; 236/34; 236/34.5; 137/627

(58) Field of Classification Search

USPC ..... 123/41.08, 41.09, 41.01, 41.02, 41.29, 123/41.33, 196 AB, 41.1, 41.49; 165/41, 165/159, 104.28, 140, 51, 135, 287, 165/FOR. 113, FOR. 104, 22; 236/34, 34.5; 137/627

See application file for complete search history.

(56) References Cited

U.S. PATENT DOCUMENTS

| | | | | |
|---|---|---|---|---|
| 6,196,168 | B1 * | 3/2001 | Eckerskorn et al. | 123/41.33 |
| 7,228,885 | B2 | 6/2007 | Kolb et al. | |
| 7,347,248 | B2 | 3/2008 | Kolb et al. | |
| 7,464,781 | B2 | 12/2008 | Guay et al. | |
| 7,506,618 | B1 | 3/2009 | Meissner et al. | |
| 7,703,420 | B1 | 4/2010 | Meissner et al. | |
| 2004/0134650 | A1 | 7/2004 | Acre | |
| 2005/0109485 | A1 | 5/2005 | Kolb et al. | |
| 2008/0060592 | A1 | 3/2008 | Mehring et al. | |
| 2008/0078537 | A1 * | 4/2008 | Desai | 165/140 |
| 2010/0262301 | A1 | 10/2010 | Schwartz et al. | |
| 2011/0073285 | A1 * | 3/2011 | Benoit et al. | 165/104.28 |

* cited by examiner

*Primary Examiner* — Hung Q. Nguyen
*Assistant Examiner* — Ruben Picon-Feliciano
(74) *Attorney, Agent, or Firm* — James Dottavio; MacMillan, Sobanski & Todd, LLC

(57) ABSTRACT

The present disclosure relates to a multiple zone vehicle radiator, including: a housing; a first zone included in the housing; a second zone included in the housing; a baffle between the first and second zone, located in an outlet manifold of the housing; and a zone modifier configured to regulate coolant distribution between the first zone and second zone according to predetermined conditions.

16 Claims, 5 Drawing Sheets

MULTI-ZONE VEHICLE RADIATORS

TECHNICAL FIELD

The present disclosure relates to thermal management systems for a vehicle powertrain, especially radiators.

BACKGROUND

Conventional vehicle powertrains are equipped with thermal management systems to control the temperature of powertrain components during vehicle operation. For example, vehicles commonly have a radiator in thermal communication with the engine to remove heat therefrom. There are also heat exchangers that warm and/or cool automatic transmission fluid when needed. It is desirable to have a multiple zone radiator with various temperature zones configured to separately cater to the thermal demands of different powertrain components (e.g., one zone for the engine and another zone for automatic transmission fluid).

U.S. Pat. No. 7,464,781 to Guay et al. titled "Three-Wheeled Vehicle Having a Split Radiator and an Interior Storage Compartment" presents the use of two separate radiators to accommodate vehicle packaging restraints. The '781 patent teaches that the radiators can be arranged in series or in parallel. However, the radiators are housed in different locations and said radiators appear to be dedicated to engine oil cooling only.

It is more beneficial to have a single radiator with designated sections or zones for different cooling temperatures. A single radiator unit generally requires less parts, assembly time and packaging space and would result in less weight for the vehicle. The utilization of a single radiator can also yield significant undesirable results. For example, the temperature differential between zones can cause unwanted structural strain on the radiator housing. Commonly, when coolant is flowing through one zone but not flowing in an adjacent zone the radiator housing can be subject to unwanted strain. Radiator channels can thermally expand at a higher rate in zones where coolant is flowing than the channels without coolant flowing.

One solution available in the automotive industry is the use of an aperture (or orifice) in a baffle which divides zones of the radiator. The presence of the orifice allows flow from one zone to another whenever the zone is flowing while the other zone otherwise would not. This solution may reduce thermal strain but also reduces the cooling benefits of a multiple zone radiator with lower temperature zone. The zone intended to run colder tends to leak into the adjacent zone, which has the tendency of increasing its temperature as well as reducing flow intended for a downstream heat exchanger. Therefore, it is desirable to have a multiple zone vehicle radiator that reduces unwanted strains on the radiator housing during operation without compromising outlet temperature and flow to downstream heat exchangers.

SUMMARY

The present disclosure addresses one or more of the above-mentioned issues. Other features and/or advantages will become apparent from the description which follows.

One exemplary embodiment relates to a multiple zone vehicle radiator, including: a housing; a first zone included in the housing; a second zone included in the housing; a baffle between the first and second zone, located in an outlet manifold of the housing; and a zone modifier configured to regulate coolant distribution between the first zone and second zone according to predetermined conditions.

Another exemplary embodiment pertains to a thermal management system, having: a multiple-zone radiator; a thermostat configured to control coolant flow from the radiator to an engine; and a zone modifier configured to regulate coolant distribution between the first zone and second zone of the radiator according to predetermined conditions.

Another exemplary embodiment relates to a thermal management system, including: a multiple-zone radiator; a jumper line between outlet lines of a first zone of the radiator and a second zone of the radiator; a thermostat configured to control coolant flow from the radiator to an engine; and a zone modifier in the jumper line configured to regulate coolant distribution between outlet lines from a first zone and a second zone of the radiator according to predetermined conditions.

One advantage of the present disclosure is that it teaches the use of a zone modifier to avoid situations in which one thermal zone is flowing at a significantly different rate than the other zone thus significantly avoiding unwanted strain on the radiator caused by thermal differentials, without reducing coolant flow or raising temperature of coolant intended for downstream heat exchangers when both zones are flowing at more similar rates.

The invention will be explained in greater detail below by way of example with reference to the figures, in which the same reference numbers are used in the figures for identical or essentially identical elements. The above features and advantages and other features and advantages of the present invention are readily apparent from the following detailed description of the best modes for carrying out the invention when taken in connection with the accompanying drawings. In the figures:

DETAILED DESCRIPTION

Figure 1:
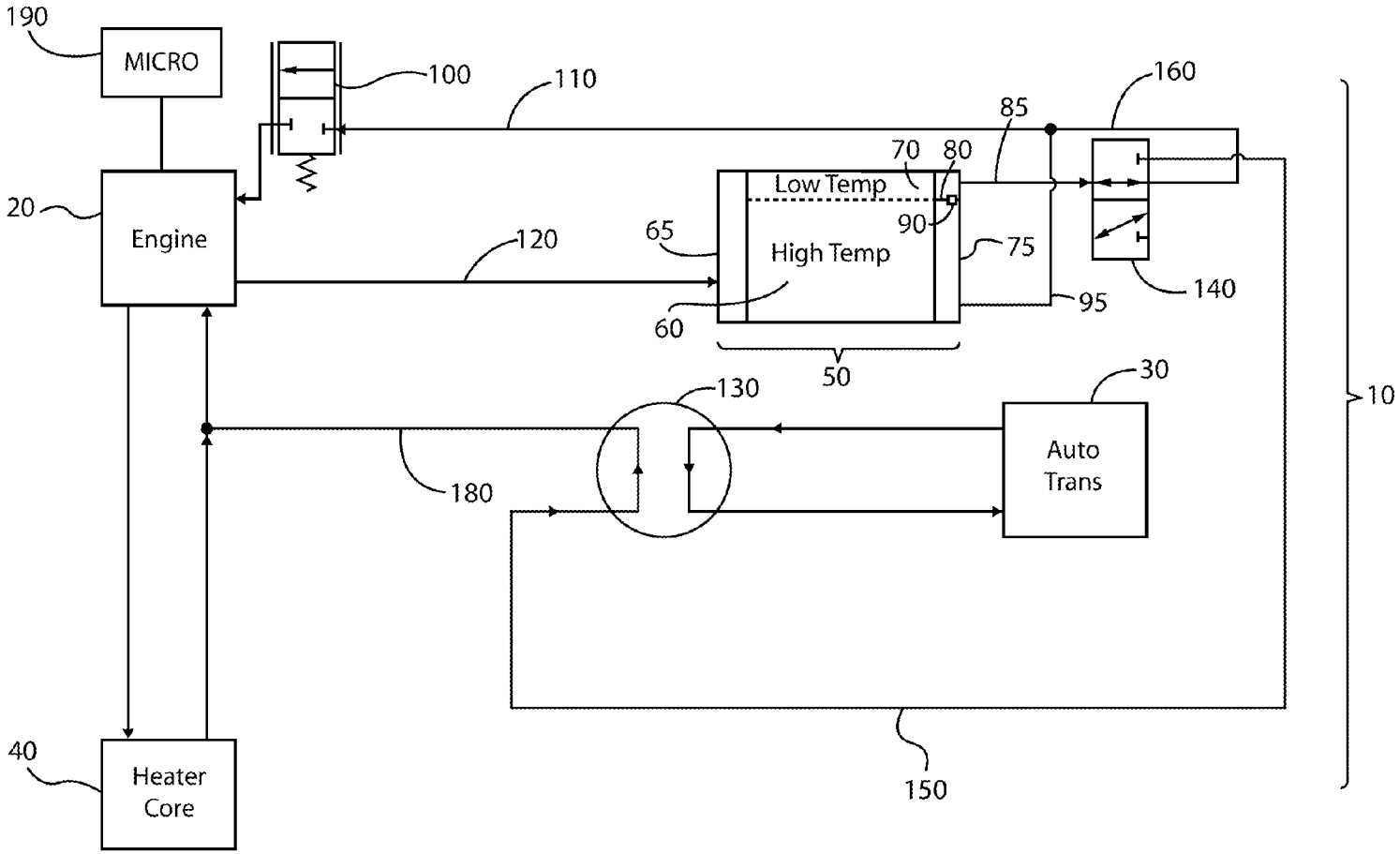
FIG. 1 is a schematic depiction of a vehicle powertrain with an exemplary powertrain thermal management system.

Referring to the drawings, wherein like characters represent examples of the same or corresponding parts throughout the several views, there are shown various powertrain thermal management systems with radiators having multiple thermal zones. The radiators are configured with more than one thermal zone, enabling the radiators to have a hot section and a cold section. Each thermal management system has a zone modifier to selectively enable coolant flow between zones when needed. For example, if the pressure differential between the two zones exceeds a predetermined threshold zone modifiers are configured to pass coolant from the high pressure zone to the low pressure zone.

Now turning to FIG. 1 there is shown therein a schematic depiction of a vehicle powertrain having an exemplary powertrain thermal management system 10. The powertrain includes a gas engine 20 (or internal combustion engine) and an automatic transmission 30. Any type of engine can be used with the thermal management system including, but not limited to inline engines, v-type engines, Wankels or diesel engines. Also, any of transmission can be used with the thermal management systems, including but not limited to, five- to nine-speed transmissions, continuously variable transmissions, electrically variable transmissions, dual-clutch transmissions, or manuals. Alternately, a power transfer unit or any other device using coolant for cooling can be assumed in place of transmission 30. The illustrated embodiment includes an automatic transmission and the thermal management system 10 is configured to control the temperature of automatic transmission fluid.

As shown in FIG. 1, the engine 20 is connected to a heater core 40 that supports the vehicle heating ventilation and cooling system (or HVAC). Any type of heater core can be used. The engine 20 is configured to be cooled by a vehicle radiator 50. Line 120 delivers coolant from the engine to the radiator 50. Radiator 50 is a multiple zone radiator having two zones 60, 70 in this embodiment. Radiator 50 has an inlet manifold 65 and an outlet manifold 75. The inlet manifold 65 directs coolant to both zones 60, 70. The outlet manifold 75 includes a baffle 80 which divides the zones where each zone will discharge through a different outlet in the radiator 50. Zone 1, 60, is dedicated to engine cooling, where coolant flow is intended to be relatively high to improve engine cooling. Zone 2, 70, will also provide coolant to the engine but the flow rate in this embodiment is lower than the flow rate in Zone 1 in order to achieve a lower outlet temperature. Said lower outlet temperature is advantageous to cooling other driveline components using oil to coolant heat exchangers. Baffle 80 substantially prevents fluid travel between the zones. Baffle 80 includes a zone modifier 90 that selectively enables fluid distribution between zones.

As shown, the engine 20 is linked to Zone 1, 60, which discharges coolant through the outlet manifold 75 to line 95. Line 95 links to line 110 which returns coolant to a thermostat 100. Thermostat 100 in this embodiment is a dual-stage continuous regulator valve configured to regulate engine inlet temperature, which has the effect of closing under operating conditions where the engine 20 does not require cooling from the radiator 50. When thermostat 100 is closed Zone 1, 60, is not providing coolant to the engine 20. At the same time, since there is no flow in the radiator Zone 1, 60, approaches ambient temperature. Zone 2 continues operating at a higher temperature when valve 140 is providing flow to the heat exchanger 130. The pressure in Zone 1, 60, increases to be higher than Zone 2, 70, in the outlet manifold, 75, which presents the opportunity for a zone modifier 90 to enable flow from Zone 1 to Zone 2. This arrangement results in less thermal strain to the radiator housing. In this embodiment, zone modifier 90 is actuated under conditions where thermostat 100 is closed and valve 140 provides coolant to heat exchanger 130 thus producing a substantial pressure differential between the two zones 60, 70. Zone modifier 90 is preferably a check valve, allowing flow from Zone 1, 60, to Zone 2, 70, when Zone 1 runs at a predetermined higher pressure. Zone modifier 90 does not allow flow from Zone 2 to Zone 1 when the predetermined pressure differential is unmet. When the thermostat is barely open, similar function is expected.

Also shown in FIG. 1, line 85 directs coolant from Zone 2, 70, to valve 140. Valve 140 in this embodiment is a dual-stage diverter valve. Valve 140 can direct coolant to line 160 or 150 depending on position of the valve. Line 150, connects valve 140 to a heat exchanger, 130. Line 180 fluidly connects heat exchanger 130 to the heater core return line, returning coolant to the engine. When the transmission fluid requires cooling, valve 140 provides coolant to the transmission heat exchanger 130 through line 150. When the transmission does not require cooling, valve 140 directs Zone 2, 70, coolant directly to line 160, which is linked to line 110. In this embodiment, heat exchanger 130 is a transmission fluid cooler but can be a power transfer unit fluid cooler as well. In other embodiments heat exchanger 130 is an engine oil cooler or other alternative purpose cooler. In other embodiments, the heat exchanger 130 can be integrated with the transmission 30 or other device requiring use of coolant for cooling.

Thermal management system 10 as shown in FIG. 1, includes microcontroller 190 configured to govern control valve 140 according to powertrain operating conditions. Microcontroller can be incorporated in other vehicle control modules including but not limited to the engine control unit, transmission control unit, battery control module or vehicle control module. Microcontroller can be any sort of computer or control circuit such as a computer having a central processing unit, memory (e.g., RAM and/or ROM), and associated input and output buses. The microcontroller can be application-specific integrated circuits or may be formed of other logic devices.

Figure 2:
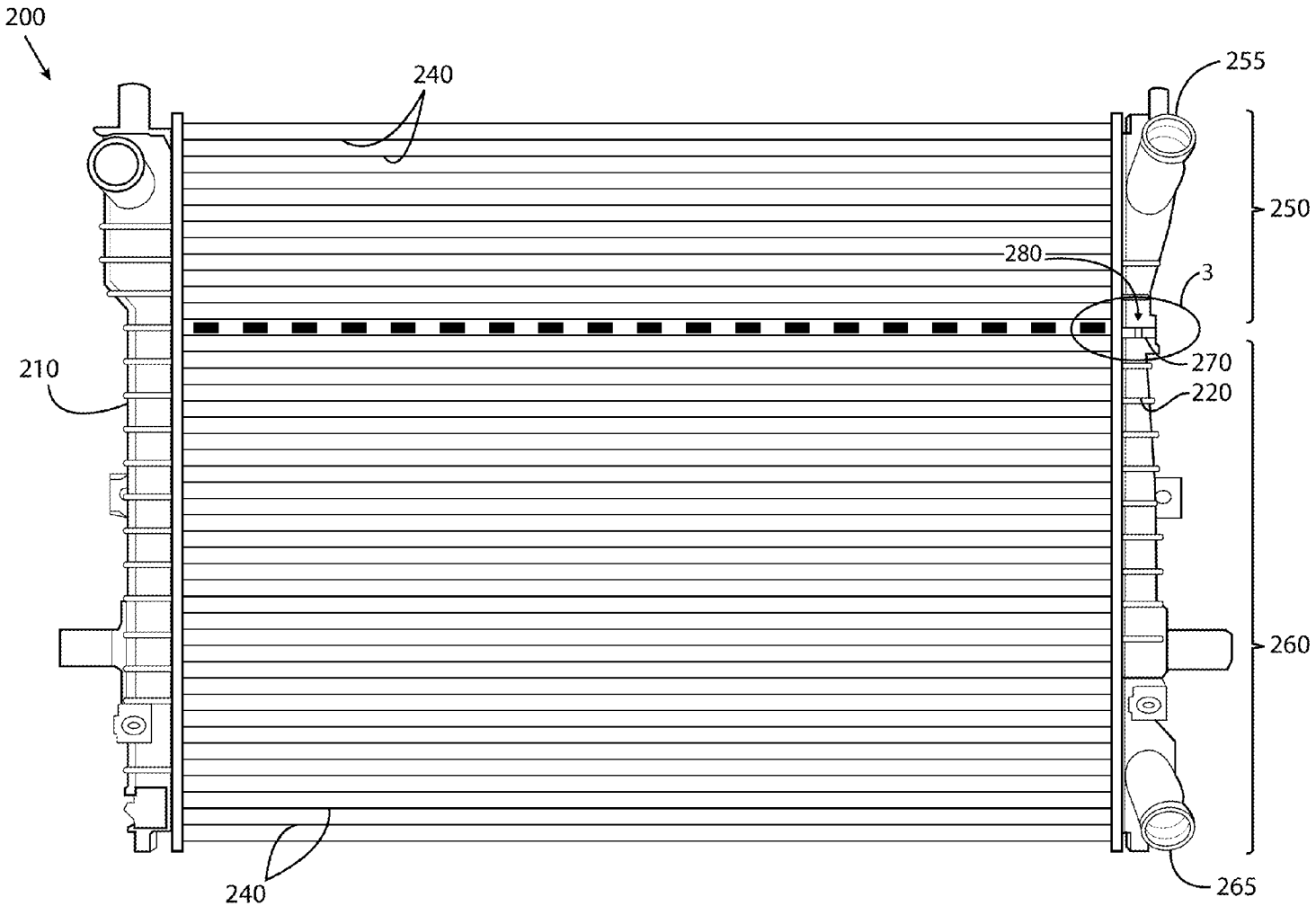
FIG. 2 is a front view of an exemplary multi-zone radiator compatible with the thermal management system shown in FIG. 1.

Now with reference to FIG. 2, there is shown therein a radiator 200 that is compatible with a thermal management system, e.g., 10 as shown in FIG. 1. In FIG. 2, a front, partial cross-sectional view of the radiator 200 is shown. The radiator 200 includes an inlet and outlet manifold, 210 and 220, respectively that define the radiator housing. Several channels 240 pass coolant from the inlet manifold 210 to the outlet manifold 220 while dropping temperature of the coolant. A first zone 260 is defined as the lower section of the radiator 200. A second zone 250 is defined as the upper section of the radiator 200. Manifold 220 includes an outlet 265 for Zone 1 and an outlet 255 for Zone 2. Baffle 270 is included in the manifold 220 and divides the outlet manifold 220. Baffle 270 includes an aperture 280 into which a zone modifier (e.g., 300 as discussed with respect to FIG. 3) is included. Aperture 280 houses a zone modifier (examples of which are shown as 300, 400 and 500 in FIGS. 3, 4 and 5, respectively) which can selectively act as a second outlet spigot for Zone 1, 260, while preventing the aperture from being a second outlet for Zone 2. In this embodiment, Zone 2, 250, flows fluid at a lower velocity than Zone 1, 260, in order to lower the outlet temperature of coolant from Zone 2. In another embodiment, the positions of the zones are interchanged.

Figure 3:
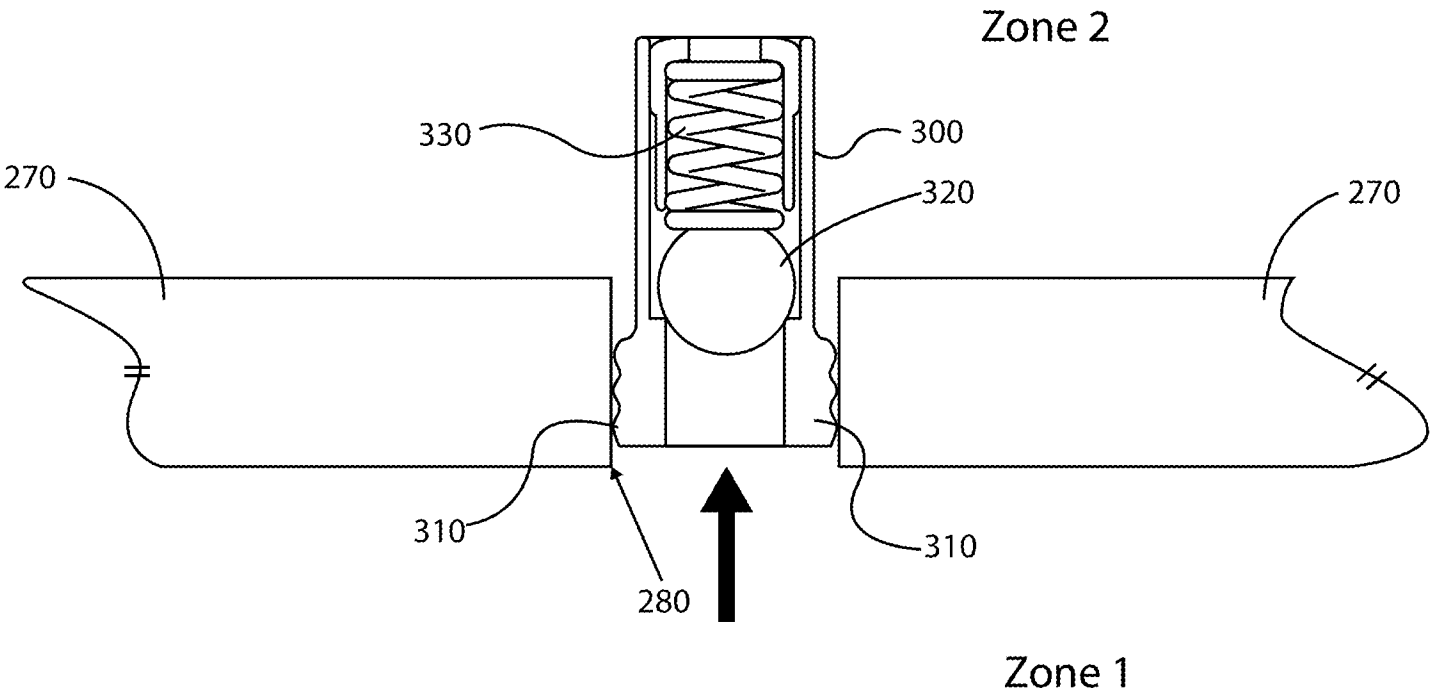
FIG. 3 is a cross-sectional view of an exemplary check valve installed in a baffle between zones in the radiation of FIG. 2, shown at circle 3.

FIG. 3 illustrates the zone modifier 300 used with the radiator 200 of FIG. 2. Zone modifier 300 is positioned in the baffle 270 between Zones 1 and 2. In FIG. 3, the baffle 270 shown in FIG. 2 is partially shown in cross-section. Zone modifier 300 is fitted in the aperture 280. When Zone 2 is at a higher pressure than Zone 1, the zone modifier will not allow coolant to flow between zones. When Zone 1 is at a higher pressure than Zone 2, the zone modifier will allow flow from Zone 1 to Zone 2. As shown in FIG. 1, one incident causing undesirable thermal strain is when the engine thermostat, 100, is closed or significantly reducing flow across Zone 1, 60, while diverter valve 140 actuates to direct Zone 2, 70, flow to heat exchanger 130. This situation will result in a pressure differential between Zone 1 and Zone 2 that will actuate the zone modifier 300 to pass flow from Zone 1 to Zone 2, which will increase flow in Zone 1, increasing temperature of the channels in Zone 1 to be more similar to Zone 2, minimizing thermal strain.

The zone modifier 300 shown in FIG. 3 is a spring loaded ball check valve (or pressure relief valve). Check valve 300 includes a retention feature 310 as an interface with the aperture 280 in baffle 270. In other embodiments, other retention features are incorporated in the check valve. A ball 320 is held in position by spring 330 with respect to the inlet side of the valve. The spring constant is designed or tuned to enable the check valve to open when the pressure differential between Zone 1 and Zone 2 exceeds a predetermined threshold (e.g., 3 psi). Alternatively, the spring can be omitted if the desired pressure differential is zero psi.

Figure 4:
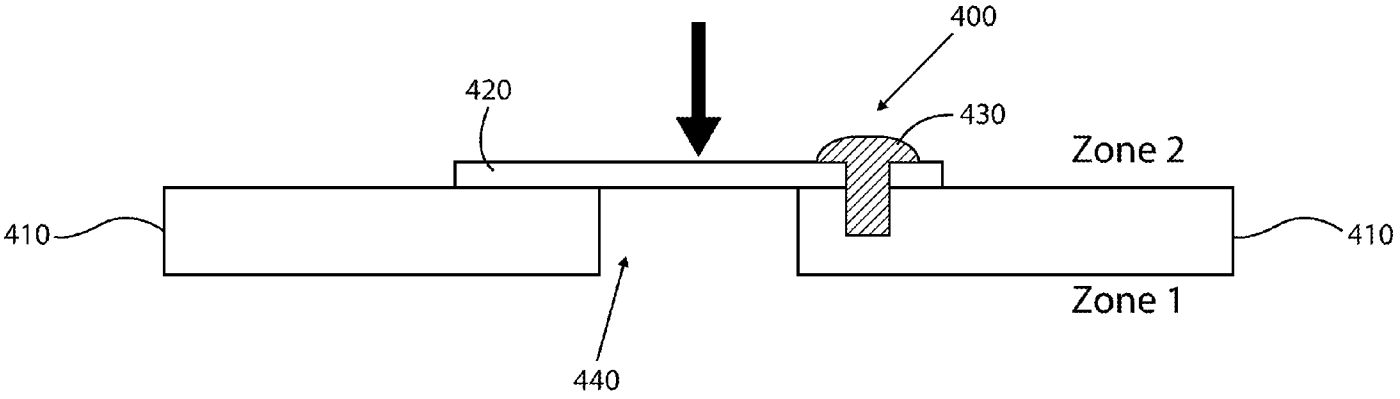
FIGS. 4 and 5 illustrate cross-sectional views of another exemplary check valve in opened and closed positions, respectively.
Figure 5:
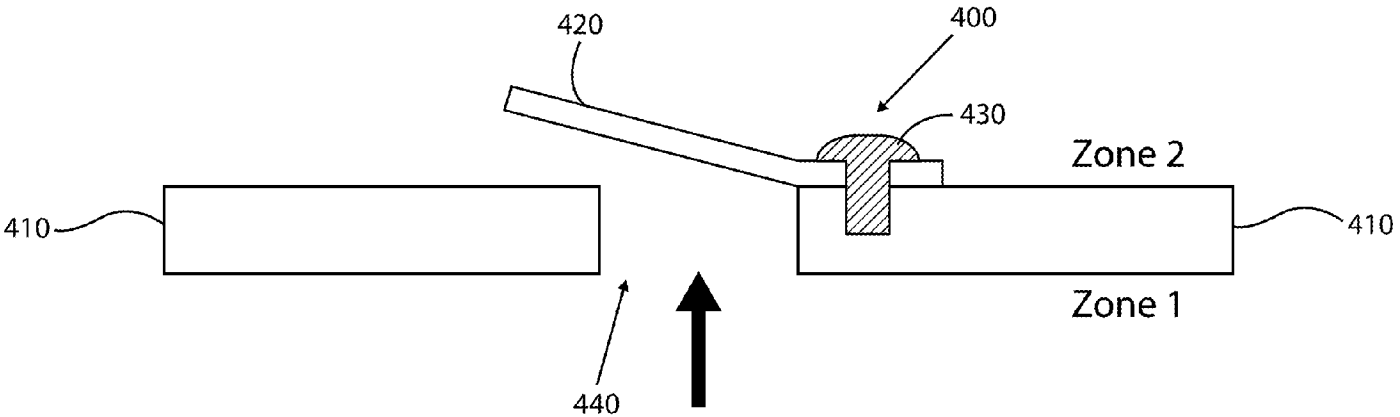

Now turning to FIGS. 4 and 5 there is shown an alternative zone modifier 400 for use in a multiple zone radiator. FIG. 4 illustrates the zone modifier 400 in a closed position. Zone 1 on the lower side of the baffle 410 is designated as the hot side of the radiator. Zone 2 on the upper side of the baffle 410 is designated as the cooler side of the radiator. Zone modifier 400 is a swing check valve that includes a flexible flap or flange 420 attached to one side of the baffle 410 via a rivet 430. Other attachment methods can be used (e.g., welds, nails, clamps, adhesives or staples). Flap 420 substantially covers an aperture 440 formed in the baffle 410 between the two zones. As previously mentioned, check valve 300 (or zone modifier 400 as shown in FIGS. 4-5) closes off flow between Zone 1 and Zone 2 when the pressure in Zone 2 is higher than the pressure in Zone 1. When the pressure in Zone 1 is sufficiently higher than Zone 2, outlet tank pressure in Zone 1 will push thru the aperture and lift the rubber flap to flow to low temp tank (or Zone 2). Flap 420 rotates about the attachment point, as shown in the open position of FIG. 5.

In this embodiment, flap 420 is composed of rubber. In other embodiments, flap 420 is composed of other materials (e.g., aluminum, copper, or other polymers). The elasticity of flap is designed to enable the zone modifier 400 to open when the pressure differential between Zone 1 and Zone 2 exceeds a predetermined threshold (e.g., 3 psi). In another embodiment, the zone modifier is a diaphragm check valve.

Figure 6:
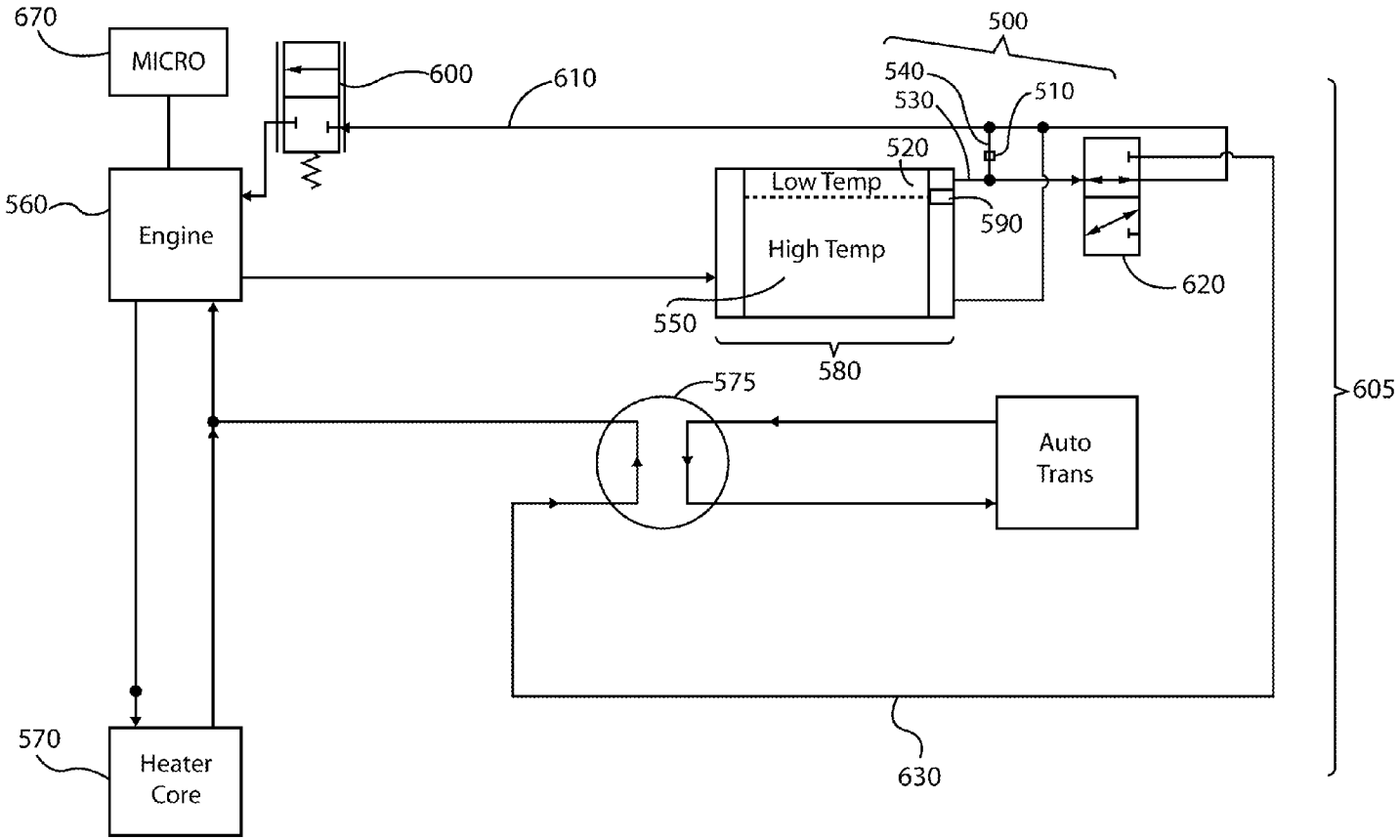
FIG. 6 is a schematic depiction of a vehicle powertrain with another exemplary powertrain thermal management system.

Another alternative embodiment of a zone modifier 500 is shown and discussed with respect to FIG. 6. As shown, a zone modifier 500 does not have to be incorporated in a baffle between sections but can be located outside of the radiator. FIG. 6 shows an alternate location for zone modifier 500. Zone modifier 500 includes a check valve 510 included in lines on the outlet end of Zone 2, 520. A T-fitting is included in outlet line 530. Jumper line 540 is added between the outlet lines of Zones 1 and 2 (610 and 530, respectively) with the check valve 510 included in the line.

As shown in FIG. 6, an engine 560 is connected to a heater core 570 that supports the vehicle heating ventilation and cooling system (or HVAC). Radiator 580 is a multiple zone radiator having two sections in this embodiment. Zone 1, 550, typically operates at a higher temperature than Zone 2, 520. In this embodiment, Zone 1, 550, is dedicated to engine cooling; Zone 2, 520, supports transmission fluid cooling as previously discussed. Zones 1 and 2 (550 and 520) are separated by baffle 590. As shown, the engine 560 is linked to radiator 580. A thermostat 600 is included between the engine 560 and radiator 580 in line 610. Thermostat 600 is a continuous dual-stage regulator valve.

Transmission fluid heat exchanger 575, shown in the schematic of FIG. 6, is selectively in thermal communication with Zone 2, 520, of the radiator 580. Zone 2, 520, is designed to run significantly cooler than Zone 1, 550. Between Zone 2 of the radiator 580 and the transmission fluid warmer is a control valve 620. Control valve 620 is a dual-stage diverter valve. When the transmission fluid requires cooling, valve 620 provides coolant to the transmission heat exchanger 575 through line 630. When the transmission does not require cooling, valve 620 directs Zone 2, 520, coolant directly to Zone 1 outlet line 610. In this embodiment, heat exchanger 575 is a transmission fluid cooler but can be a power transfer unit fluid cooler as well. In other embodiments heat exchanger 575 is an engine oil cooler or other alternative purpose cooler. In other embodiments, the heat exchanger 575 can be integrated with the transmission or other device requiring use of coolant for cooling.

Thermal management system 605 as shown in FIG. 6, includes a microcontroller 670 configured to govern, control valve 620 according to powertrain operating conditions. Check valve 510 can be a ball check valve as previously discussed with respect to FIG. 3. Check valve 510 is a flap in another embodiment (e.g., as discussed with respect to FIGS. 4 and 5).

While the best modes for carrying out the invention have been described in detail, those familiar with the art to which this invention relates will recognize various alternative designs and embodiments for practicing the invention within the scope of the appended claims.

We claim:

1. A thermal management system for a vehicle having a combustion engine and a transmission cooler, comprising:

a multiple-zone radiator having an inlet manifold with a single inlet configured to receive a coolant from the engine and having an outlet manifold divided by a baffle, wherein the radiator is configured to deliver coolant from a first zone to a first outlet and from a second zone to a second outlet;

a thermostat having an inlet receiving an unobstructed flow from the first outlet and having an outlet configured to regulate coolant flow to the engine according to an open or closed position of the thermostat;

a three-way valve having a valve inlet connected to the second outlet and configured to selectably couple the second outlet to either the transmission cooler or the inlet of the thermostat; and a zone modifier coupled between the first and second outlets of the radiator and configured to distribute coolant from the first zone and to the valve inlet in response to a coolant pressure being greater at the first outlet than at the second outlet when the thermostat is in the closed position and the three-way valve couples the second outlet to the transmission cooler.

2. The system of claim 1, wherein the system is configured so that the zones of the radiator run at different temperatures.

3. The system of claim 1, wherein the zone modifier includes a check valve.

4. The system of claim 3, wherein the check valve is configured to open when a pressure differential between zones exceeds a predetermined threshold.

5. The system of claim 4, wherein the predetermined pressure differential threshold is between 0 and 15 psi.

6. The system of claim 3, wherein the check valve is a ball check valve.

7. The system of claim 3, wherein the check valve is a swing check valve.

8. The system of claim 3, wherein the check valve is positioned with respect to an aperture in the baffle between radiator zones and the check valve is configured to selectively close the aperture.

9. The system of claim 3, wherein the check valve is positioned in a jumper line between outlet lines of the zones of the radiator and configured to regulate coolant distribution between zone outlet lines.

10. A thermal management system for a vehicle having a combustion engine and a transmission cooler, comprising:

a multiple-zone radiator having an inlet manifold with a single inlet configured to receive a coolant from the engine and having an outlet manifold divided by a baffle, wherein the radiator is configured to deliver coolant from a first zone to a first outlet and from a second zone to a second outlet;

a jumper line between outlet lines of the first and second outlets of the radiator;

a thermostat having an inlet receiving an unobstructed flow from the first outlet and having an outlet configured to regulate coolant flow to the engine according to an open or closed position of the thermostat;

a three-way valve having a valve inlet connected to the second outlet and configured to selectably couple the second outlet to either the transmission cooler or the inlet of the thermostat; and a zone modifier in the jumper line configured to distribute coolant from the first zone to the valve inlet in response to a coolant pressure being greater at the first outlet than at the second outlet when the thermostat is in the closed position and the three-way valve couples the second outlet to the transmission cooler.

11. The system of claim 10, wherein the system is configured so that the zones of the radiator run at different temperatures.

12. The system of claim 10, wherein the zone modifier is a check valve.

13. The system of claim 12, wherein the check valve is configured to open when a pressure differential between the first zone and second zone exceeds a predetermined threshold.

14. The system of claim 13, wherein the predetermined pressure differential threshold is between 0 and 15 psi.

15. The system of claim 12, wherein the check valve is a ball check valve.

16. The system of claim 12, wherein the check valve is a swing check valve.

* * * * *